US006797035B2

(12) United States Patent
Baldrey et al.

(10) Patent No.: US 6,797,035 B2
(45) Date of Patent: Sep. 28, 2004

(54) OXIDIZING ADDITIVES FOR CONTROL OF PARTICULATE EMISSIONS

(75) Inventors: Kenneth E. Baldrey, Denver, CO (US); Michael D. Durham, Castle Rock, CO (US)

(73) Assignee: ADA Environmental Solutions, LLC, Littleton, CO (US)

( * ) Notice: Subject to any disclaimer, the term of this patent is extended or adjusted under 35 U.S.C. 154(b) by 0 days.

(21) Appl. No.: 10/245,608

(22) Filed: Sep. 16, 2002

(65) Prior Publication Data

US 2004/0040438 A1 Mar. 4, 2004

Related U.S. Application Data

(60) Provisional application No. 60/407,519, filed on Aug. 30, 2002.

(51) Int. Cl.[7] ..... B03C 3/013

(52) U.S. Cl. ..... 95/58; 95/65; 95/71; 95/216; 95/230; 96/52; 96/74; 96/356; 96/360; 423/395; 423/397

(58) Field of Search ..... 95/58, 62, 64, 95/65, 71, 72, 216, 230; 96/27, 52, 53, 74, 356, 360; 423/395, 397

(56) References Cited

U.S. PATENT DOCUMENTS

| | | | | |
|---|---|---|---|---|
| 2,501,436 A | | 3/1950 | Cleveland et al. | 95/60 X |
| 2,602,734 A | | 7/1952 | Hedberg et al. | 95/71 X |
| 2,720,939 A | | 10/1955 | Stokes | 95/65 |
| 2,746,563 A | | 5/1956 | Harlow | 95/73 X |
| 2,844,112 A | | 7/1958 | Muller | 110/1 |
| 3,004,836 A | | 10/1961 | Thompson | 44/4 |
| 3,058,803 A | | 10/1962 | Hinkle, Jr. et al. | 423/531 |
| 3,284,990 A | | 11/1966 | Orne | 55/5 |
| 3,346,488 A | | 10/1967 | Lyons et al. | 507/128 |
| 3,494,099 A | | 2/1970 | Eng et al. | 55/8 |
| 3,503,704 A | * | 3/1970 | Marks | 423/212 |
| 3,523,407 A | | 8/1970 | Humbert | 55/106 |
| 3,632,306 A | | 1/1972 | Fisher et al. | 23/2 SQ |
| 3,665,676 A | | 5/1972 | McKewen | 55/4 |
| 3,755,122 A | | 8/1973 | Melcher et al. | 204/186 |
| 3,783,158 A | | 1/1974 | Platzke et al. | 423/49 |
| 3,807,137 A | | 4/1974 | Romell | 55/10 |
| 3,918,935 A | | 11/1975 | Livingston | 55/85 |
| 3,928,537 A | | 12/1975 | Saitoh et al. | 423/243 |
| 3,932,587 A | | 1/1976 | Grantham et al. | 423/242 |
| 4,042,348 A | | 8/1977 | Bennett et al. | 55/5 |
| 4,043,768 A | | 8/1977 | Bennett et al. | 55/5 |
| 4,049,462 A | | 9/1977 | Cocozza | 106/85 |
| 4,057,398 A | | 11/1977 | Bennett et al. | 44/4 |

(List continued on next page.)

FOREIGN PATENT DOCUMENTS

| | | | |
|---|---|---|---|
| DE | 1102109 | 3/1961 | 95/71 |
| GB | 2015899 A | 9/1979 | |
| JP | 55061946 | 5/1980 | 95/71 |
| WO | WO 96 404436 | 12/1996 | |

OTHER PUBLICATIONS

Roy E. Bickelhaupt, "An Interpretation of the Deteriorative Performance of Hot–Side Precipitators"; *Journal of the Air Pollution Control Association*, 30:882 (Aug. 1980).

(List continued on next page.)

*Primary Examiner*—Richard L. Chiesa
(74) *Attorney, Agent, or Firm*—Sheridan Ross P.C.

(57) ABSTRACT

The present invention discloses a process for removing undesired particles from a gas stream including the steps of contacting an additive containing nitrate and/or nitrite anions with the gas stream; collecting the undesired particles and additive on a collection surface to form an aggregate on the collection surface comprising the additive and undesired particles; and removing the agglomerate from the collection zone. The anions can be compounded with one or more of potassium, sodium, calcium, and aluminum. In a preferred composition, the anion(s) is/are compounded with potassium. The process may be applied to electrostatic precipitators to improve undesired particle collection efficiency.

45 Claims, 7 Drawing Sheets

U.S. PATENT DOCUMENTS

| | | | | |
|---|---|---|---|---|
| 4,070,424 | A | 1/1978 | Olson et al. | 261/142 |
| 4,095,962 | A | 6/1978 | Richards | 55/10 |
| 4,113,447 | A | 9/1978 | Bennett et al. | 55/5 |
| 4,121,945 | A | 10/1978 | Hurst et al. | 106/288 B |
| 4,123,234 | A | 10/1978 | Vossos | 55/5 |
| 4,132,535 | A | 1/1979 | Rivers, Jr. et al. | 55/23 |
| 4,177,043 | A | 12/1979 | Albanese | 55/5 |
| 4,197,278 | A | 4/1980 | Gehri et al. | 423/242 |
| 4,222,748 | A | 9/1980 | Argo et al. | 55/6 |
| 4,226,601 | A | 10/1980 | Smith | 44/10 D |
| 4,239,504 | A | 12/1980 | Polizzotti et al. | 55/5 |
| 4,247,321 | A | 1/1981 | Persinger | 71/59 |
| 4,306,885 | A | 12/1981 | Kober et al. | 55/5 |
| 4,313,762 | A | 2/1982 | Pound | 106/85 |
| 4,325,711 | A | 4/1982 | Kober et al. | 55/5 |
| 4,337,231 | A | 6/1982 | Yaguchi et al. | 423/243 |
| 4,372,227 | A | 2/1983 | Mahoney | 110/342 |
| 4,377,118 | A | 3/1983 | Sadowski | 110/343 |
| 4,438,709 | A | 3/1984 | Borio | 110/347 |
| 4,439,351 | A | 3/1984 | Sinha | 252/500 |
| 4,533,532 | A | 8/1985 | Gebhard et al. | 423/244 |
| 4,541,844 | A | 9/1985 | Malcolm | 55/10 |
| 4,581,210 | A | 4/1986 | Teller | 423/242 |
| 4,598,652 | A | 7/1986 | Hepworth | 110/345 |
| 4,600,569 | A | 7/1986 | Yoon | 423/243 |
| 4,604,269 | A | 8/1986 | Yoon | 423/242 |
| 4,615,871 | A | 10/1986 | Yoon | 423/243 |
| 4,618,376 | A | 10/1986 | Saternus et al. | 134/26 |
| 4,629,572 | A | 12/1986 | Leitz et al. | 210/714 |
| 4,678,481 | A * | 7/1987 | Diep | 95/65 |
| 4,737,356 | A | 4/1988 | O'Hara et al. | 423/659 |
| 4,738,690 | A | 4/1988 | Radway et al. | 55/5 |
| 4,741,278 | A | 5/1988 | Franke et al. | 110/342 |
| 4,749,492 | A | 6/1988 | Berrigan, Jr. et al. | 210/616 |
| 4,765,258 | A | 8/1988 | Zauderer | 110/347 |
| 4,777,024 | A | 10/1988 | Epperly et al. | 423/235 |
| 4,778,598 | A | 10/1988 | Hoffman et al. | 210/710 |
| 4,780,289 | A | 10/1988 | Epperly et al. | 423/235 |
| 4,793,981 | A | 12/1988 | Doyle et al. | 423/239 |
| 4,822,577 | A | 4/1989 | Epperly et al. | 423/243 |
| 4,869,846 | A | 9/1989 | Mouche et al. | 252/192 |
| 4,871,283 | A | 10/1989 | Wright | 405/263 |
| 4,872,887 | A | 10/1989 | Altman et al. | 55/5 |
| 4,874,402 | A | 10/1989 | Vogel | 55/22 |
| 4,885,139 | A | 12/1989 | Sparks et al. | 422/169 |
| 4,886,519 | A | 12/1989 | Hayes et al. | 44/51 |
| 4,888,158 | A | 12/1989 | Downs | 423/242 |
| 4,891,195 | A | 1/1990 | Lin | 423/243 |
| 4,908,194 | A | 3/1990 | Hooper | 423/235 |
| 4,931,073 | A | 6/1990 | Miller et al. | 55/96 |
| 4,935,209 | A | 6/1990 | Pfoutz | 422/128 |
| 4,954,324 | A | 9/1990 | Hooper | 423/239 |
| 4,999,167 | A | 3/1991 | Skelley et al. | 422/175 |
| 5,022,329 | A | 6/1991 | Rackley et al. | 110/234 |
| 5,032,154 | A | 7/1991 | Wright | 55/106 |
| 5,034,030 | A | 7/1991 | Miller et al. | 55/96 |
| 5,037,479 | A | 8/1991 | Stanforth | 106/691 |
| 5,052,312 | A | 10/1991 | Rackley et al. | 110/346 |
| 5,066,316 | A | 11/1991 | Ikeda | 55/122 |
| 5,074,226 | A | 12/1991 | Lynch | 110/345 |
| 5,089,142 | A | 2/1992 | Turunc | 210/728 |
| 5,106,601 | A | 4/1992 | Chang et al. | 423/235 |
| 5,196,038 | A | 3/1993 | Wright | 55/5 |
| 5,196,648 | A | 3/1993 | Jones | 102/307 |
| 5,215,575 | A | 6/1993 | Butler | 75/744 |
| 5,224,595 | A | 7/1993 | Sugimoto et al. | 206/321 |
| 5,240,470 | A | 8/1993 | Wright | 95/58 |
| 5,256,198 | A | 10/1993 | Sinha | 106/708 |
| 5,261,931 | A | 11/1993 | Wright | 95/3 |
| 5,284,636 | A | 2/1994 | Goff et al. | 423/235 |
| 5,288,303 | A | 2/1994 | Woracek et al. | 95/2 |
| 5,307,743 | A | 5/1994 | Jones | 102/307 |
| 5,312,605 | A | 5/1994 | Levendis et al. | 423/210 |
| 5,324,336 | A | 6/1994 | Child | 44/608 |
| 5,351,630 | A | 10/1994 | Lister et al. | 110/165 A |
| 5,352,423 | A | 10/1994 | Levendis et al. | 423/235 |
| 5,356,597 | A | 10/1994 | Wright et al. | 422/169 |
| 5,364,421 | A | 11/1994 | Westby et al. | 44/608 |
| 5,370,720 | A | 12/1994 | Duncan | 55/222 |
| 5,443,805 | A | 8/1995 | Beéer et al. | 423/235 |
| 5,449,390 | A | 9/1995 | Duncan et al. | 55/5 |
| 5,547,495 | A | 8/1996 | Wright | 96/74 |
| 5,681,384 | A | 10/1997 | Liskowitz et al. | 106/710 |
| 5,707,422 | A | 1/1998 | Jacobsson et al. | 95/6 |
| 5,785,936 | A | 7/1998 | Levendis | 423/210 |
| 5,795,367 | A | 8/1998 | Kennedy et al. | 95/3 |
| 5,810,920 | A | 9/1998 | Ueshima et al. | 106/697 |
| 5,833,736 | A | 11/1998 | Durham et al. | 95/71 |
| 5,855,649 | A | 1/1999 | Durham et al. | 95/71 |
| 5,893,943 | A | 4/1999 | Durham et al. | 95/65 |
| 5,902,380 | A | 5/1999 | Tomimatsu et al. | 96/27 |
| 6,001,152 | A | 12/1999 | Sinha | 95/58 |
| 6,221,001 | B1 | 4/2001 | Comer et al. | 588/252 |
| 6,267,802 | B1 | 7/2001 | Baldrey et al. | 95/58 |

OTHER PUBLICATIONS

Bustard et al., "Non–Toxic Additives for Improved Fabric Filter Performance"; Eleventh Annual Coal Preparation, Utilization, and Environmental Control Contractors Conference, Pittsburgh Energy Technology Center; Jul. 12–14, 1995, pp. 1–8.

Calgon Corporation Paper Entitled "Relative Efficiency of Phosphates Used in Boiler Water Conditioning"; 4 pages, Oct. 29, 1998.

Durham et al., "Bench–Scale and Pilot–Plant Evaluation of Additives for Improved Particle Collection in Electrostatic Precipitators"; Tenth Annual Coal Preparation, Utilization, and Environmental Control Contractors Conference, Pittsburgh Energy Technology Center; Jul. 18–21, 1994; pp. 1–7.

IEEE Standard 548–1984, "Laboratory Measurement and Reporting of Fly Ash Resistivity"; Power Generation Committee of the IEEE Power Engineering Society, published by The Institute of Electrical and Electronics Engineers, Inc. (Dec. 21, 1984), pp. 7–30.

Krigmont, Coe, Miller and Laudal; "Enhanced ESP Fine Particle Control by Flue Gas Conditioning" EPRI Ninth Particulate Control Symposium, Oct. 15–18, 1991, pp. 1–21.

Paul Platt et al., "Opacity Control While burning Western Coal at Harrington Station"; Presented at Western Fuels Conference, Aug. 1992, La Crosse, WI.

W.L. Sage et al., "Relationship of Coal–Ash Viscosity to Chemical Composition," *Journal of Engineering for Power*, (Apr. 1960) pp. 145–155.

Calgon Corporation paper entitled "Material Safety Data Sheet", 6 pages, Sep. 25, 1998.

"Cyclone Furnaces," Steam/its generation and use, Chapter 10 (Babcock & Wilson) 37 pages (1972).

U.S. patent application SN 09/354,962 filed on Jul. 16, 1999.

* cited by examiner

OXIDIZING ADDITIVES FOR CONTROL OF PARTICULATE EMISSIONS

CROSS REFERENCE TO RELATED APPLICATION

This application claims the benefits under 35 U.S.C. §119(e) of U.S. Provisional Application Ser. No. 60/407,519, filed Aug. 30, 2002, to Baldrey et al., which is incorporated herein by reference in its entirety.

FIELD OF THE INVENTION

The present invention is a method and apparatus for removing undesired particles, such as fly ash, from gas streams. More particularly, the present invention embodies an improved approach for removing such undesired particles by selectively introducing oxidants into the gas stream.

BACKGROUND OF THE INVENTION

Environmental standards for particulate emissions from coal-fired electrical power plants, petroleum refineries, chemical plants, pulp and paper plants, cement plants, and other particulate-emitting facilities are becoming increasingly more demanding. For example, air quality standards in the United States now require power plants to remove more than 99% of the particulates produced by coal combustion before the flue gas can be discharged into the atmosphere. The term "particulate" within the meaning of these restrictions generally refers to fly ash and other fine particles found in flue gas streams and can include a host of hazardous substances such as those listed in 40 CFR §302.4 (e.g., arsenic, ammonia, ammonium sulfite, heavy metals and the like. As environmental standards tighten, there is a corresponding need for a more efficient means of particulate removal.

An electrostatic precipitator is a commonly used device for removing electrically particulates from the gas streams produced by plants and refineries. In a typical electrostatic precipitator, undesired particle-laden gases pass negatively charged corona electrodes which impart a negative charge to the particulates. The charged particulates then migrate towards and collect on positively charged collection plates and are intermittently removed by various techniques, including sonic horn blasts or rapping of the collection plates. Electrostatic precipitators may employ a common stage or separate stages for both the charging and collection of particulates.

In utility applications, there are two types of electrostatic precipitators. Cold-side electrostatic precipitators are located on the downstream side of the air preheater or heat exchanger (which transfers heat from the flue gas to the air to be fed into the furnace) and therefore operate at relatively low temperatures (i.e., temperatures of less than about 200° C.). Hot-side electrostatic precipitators are located on the upstream side of the air preheater and therefore operate at relatively high temperatures (i.e., at least about 250° C.).

Many hot-side electrostatic precipitators suffer from problems related to the resistivity of collected particulates. Such problems can cause a deterioration of the particulate collection efficiency of the electrostatic precipitator (and higher particulate emissions) and excessive ESP power consumption. These problems can be caused by sodium depletion of collected particulates on the collection plates. It has long been known that ionic charge transfer through the collected particulate layer at high temperatures can be degraded as available charge carriers, namely sodium cations, are depleted from the collected particulate layer. This phenomenon is commonly referred as sodium depletion. The problems can also be caused by the inherently high resistivity of particulates and/or resistivity problems during low load or at colder temperatures.

Additives, such as sulfur trioxide, ammonia, and various surface conditioning additives (such as sulfuric acid) that are effective under cold-side conditions are generally ineffective under hot-side conditions because of different charge conduction mechanisms. Referring to FIG. 1, under cold-side conditions (which exist at operating temperatures less than the critical temperature) surface conduction of charge is believed to be the predominant charge conduction mechanism while under hot-side conditions (which exist typically at operating temperatures more than the critical temperature) volume conduction of charge through the particulates is believed to be the predominant charge conduction mechanism. As used herein, the "critical temperature" is the temperature corresponding to the highest attainable resistivity of a particulate (which is commonly located at the top of a bell-shaped curve as shown in FIG. 1). As can be seen from FIG. 1, particulate electrical resistivity varies with temperature over as much as two orders of magnitude at normal process temperatures for hot-side ESPs.

For the reasons set forth above, an effective flue gas conditioning treatment under hot-side conditions therefore should prevent or substantially delay long-term ion (e.g., sodium) depletion and moderate resistivity for highly variable particulate compositions and process temperatures.

One conditioning method for controlling particulate resistivity that has had some success under hot-side conditions has been bulk addition of sodium into the coal feed to the boiler. Typically, from about 0.5 to about 4% by weight sodium (relative to the weight of the ash in the coal) is added to the coal feed as a sodium sulfate or soda ash. The sodium is co-fired with the coal in the boiler resulting in the sodium being incorporated into the particulates as sodium oxides.

The bulk addition of sodium to the coal feed can, however, cause problems. For example, bulk sodium addition can cause boiler slagging and boiler and economizer fouling due to the high sodium content of the particulates (substantially negating any gains by reduced ESP cleaning). Bulk sodium addition can lead to the consumption of excessive amounts of alkali material (and a commensurate increase in operating costs) and to higher gas temperatures downstream of the boiler (that can lead to duct and electrostatic precipitator structural problems). Bulk sodium addition may not effectively control sodium depletion, because the added sodium charge carriers are contained as sodium oxides in the bulk particles. Therefore, a thin layer of collected particulates next to the plate that is never rapped clear (or removed from the plate) will still be subject to sodium depletion and higher electrical resistivity as the sodium ions in the collected thin layer migrate to the plate. Once sodium depletion is established in the collected thin particulate layer, bulk sodium addition becomes less and less effective over time. Compared to the absence of bulk sodium addition, it is common that the prolonged bulk addition of sodium may delay or extend time between ESP cleaning by only a few months. Bulk sodium addition often cannot be performed on an intermittent or as-needed basis and thereby fails to provide control over short-term particulate resistivity. The sodium content of the coal supply is a major contributor to the electrical resistivity of the resulting fly ash. The sodium content can range from less than 0.5% to more than 2% depending on the coal supply. Coal sodium content is variable over a period of days to weeks with a lag time of several hours from when new coal is loaded into the feed bunkers to its full effect on ESP performance. There is no real-time feedback to determine optimum sodium content in the as-fired coal. Therefore, the bulk sodium addition rate is adjusted based on observed changes in stack opacity and ESP power. Bulk sodium rate adjustments are made several hours after as-fired coal changes and the effects of a rate change do not take effect for several additional hours.

Another hot-side conditioning method is to inject sodium-precursor chemicals, notably carboxylic acid salts, into the flue gas stream as a finely atomized liquid spray. This conditioning method is discussed in detail in U.S. Pat. No. 6,267,802. The conditioning mechanism is enrichment of sodium ion charge carriers on the collected particulates. Advantages compared to bulk sodium addition to the coal include the co-precipitation of chemical and sodium ion charge-carriers with the particulates, the use of only a small fraction of the material required for bulk sodium addition, the avoidance of detrimental boiler slagging and fouling, and the rapid and precise adjustment of additive application rate.

Sodium precursor chemicals, however, may be unable to address short-term ESP performance problems related to load, coal, resistivity and gas temperature. Sodium precursor chemicals sometimes cannot overcome severe short-term resistivity changes associated with temperature swings during unit load changes and can be less effective on the lower temperature hot-side ESPs because the inherent particulate resistivity is higher.

Yet another hot-side conditioning method that has had some success under hot-side conditions has been the introduction of sodium nitrate into the flue gas stream. Sodium nitrate conditioning additives have been sold under the trade name "COMBUSTROL FACT 5000" by Calgon Corporation and are discussed in U.S. Pat. No. 6,001,152. The sodium nitrate is dissolved in a liquid, and the liquid additive is atomized and introduced into the flue gas stream.

A problem with the use of sodium nitrate in the flue gas stream is the lack of long-term control over ash resistivity. Although the sodium nitrate additive can produce a significant, initial decrease in resistivity, it has been observed that the decrease in resistivity rapidly degrades over time and returns to unconditioned particulate resistivity levels. Accordingly, a relatively high amount of the additive is required to realize acceptable levels of ESP performance, leading to higher operating costs when compared to sodium precursor chemicals. Sodium nitrate is also ineffective when process temperatures are above about 725° F. (385° C.) due to rapid thermal decomposition.

SUMMARY OF THE INVENTION

These and other needs are addressed by the additive(s) of the present invention. Generally, the additives of the present invention utilize metal nitrate(s) and/or nitrite(s) to provide effective conditioning of particulates under both cold-side and hot-side conditions.

In one embodiment of the present invention a process is provided for removing undesired solid particles (e.g., particulates) from a gas stream (e.g., a flue gas stream) that can realize these and other objectives. The process includes the steps of:

(a) contacting (e.g., injecting) with the gas stream a composition including a solid or liquid additive composition that preferably includes potassium nitrate and/or nitrite and optionally one or more other metal (other than potassium) nitrates and/or nitrites;

(b) collecting on at least one collection surface in a collection zone a solid agglomerate including at least a portion of the additive composition or a derivative(s) thereof and at least a portion of the undesired solid particles; and (c) removing the agglomerate from the collection surface. As used herein, "agglomerate" refers to a cluster or accumulation of undesired particles and additive particles and "condensation temperature" refers to the temperature at which a given vapor component of a gas stream condenses into a liquid under ambient pressure.

The additive is particularly effective under hot-side conditions. The temperature of the gas stream under hot-side conditions is typically at least about 250° C. (480° F.), more typically ranges from about 270° C. (520° F.) to about 480° C. (900° F.), and even more typically from about 177° C. (350° F.) to about 400° C. (750° F.)

Surprisingly and unexpectedly, potassium nitrate has proven more effective than sodium nitrate in lowering collected particle resistivity over both short- and long-term periods. For example, the additive, due to its higher degree of thermal stability, can provide long-term resistivity enhancement at temperatures of more than 725° F. (385° C.) and up to about 800° F. As noted, a prominent theory for the occurrence of high resistivity in electrostatic precipitators is the sodium depletion theory which holds that high resistivity develops in the accumulated undesired particle layer because of the migration of sodium ions towards the collection plates, thereby increasing the resistivity of the accumulated particle layer. Surprisingly and unexpectedly, when potassium is compounded with the nitrate anion, the metal cations and nitrate anions migrate freely throughout the layer and provide significant, long term reductions in the resistivity of the collected, undesired particle layer.

The additive in the composition can be nontoxic and substantially odorless. An additive is typically deemed "nontoxic" if the presence of the additive in the resultant agglomerate does not cause the agglomerate to be environmentally unacceptable under the standards and procedures set forth in the Toxicity Characteristic Leaching Procedure ("TCLP") established by the United States Environmental Protection Agency. The TCLP provides analysis procedures for waste materials to detect environmentally unacceptable levels of substances, including inorganic elements, volatile organic compounds, and semi-volatile organic compounds. The TCLP specifies the maximum acceptable concentration for such substances. An additive is deemed to be "odorless" if the presence of the additive in the agglomerate cannot be detected by the human nose.

Because of the solubility limits of the potassium nitrate and nitrites in the selected solvent (e.g., water), other types of metal nitrates and/or nitrites can be incorporated into the additive to provide a higher effective concentration of the nitrate and/or nitrate anion. In one formulation, the additive includes potassium nitrate, potassium nitrite, and nitrates and/or nitrites compounded with other metals. In another formulation, the additive includes potassium nitrate and one or more of sodium, calcium, and aluminum nitrate. In yet another formulation, the additive includes potassium nitrite and a metal selected from Groups 1, 2, 6, 7, 8, 9, 10, 11, 12 and 13 of the Periodic Table and preferably one or more of sodium, calcium, and aluminum nitrite. In yet a further formulation, the additive includes only potassium nitrate and/or nitrite and no other metal nitrates and/or nitrites. In other formulations, the additive includes not only the salt but also the mineral acid precursor of the salt.

The liquid additive, as introduced into the gas stream, preferably includes at least about 0.5 wt. % potassium nitrate and/or nitrite and more preferably from about 1 to about 6 wt. % potassium nitrate and/or nitrite. The liquid additive can further include at least about 0.5 wt. % of other metal nitrates and/or nitrites and more preferably from about 2 to about 8 wt. % of the other metal nitrates and/or nitrites. The molar ratio between the potassium salts and the non-potassium salts typically ranges from about 0.2:1 to about 2:1 and even more typically from about 0.5:1 to about 0.9:1.

Unlike a liquid additive, the solid additive does not suffer from the limitations of solubility and include much higher levels of potassium nitrates and/or potassium nitrites. Preferably, the metal in at least most of the moles of metal nitrates and/or metal nitrites in the solid additive is potassium.

To provide a higher level of solubility of the various nitrate (and other oxidizing) salts in the liquid additive, the liquid additive can include one or more solubilizing agent (s). A solubilizing agent is an element or compound that causes the selected salt to have a higher solubility in the solvent than is possible under the same conditions of temperature and pH, in the absence of the agent. A preferred solubilizing agent for potassium nitrate is a peroxygen compound, such as a peroxide, with hydrogen peroxide being preferred. The solubilizing agent can be used to increase solubility levels not only for nitrates and nitrites but also for any other salt that is introduced into the gas stream. Examples of such other salts include phosphates, phosphites, carbonates, sulfates, sulfites, and mixtures thereof.

In hot side applications, the additive can substantially eliminate the potential for air preheater problems (e.g., such as build up of unwanted additive/particle deposits on the air preheater), particularly when the additive is injected as a solid. When a liquid additive is sprayed into a gas stream, a deposit of undesired particles and additive can form. Such deposits commonly form at the point of injection and on metal surfaces downstream from the injection point, such as air preheaters and electrostatic precipitator electrodes. The additive, when injected into a heated, moist gas stream as a fine mist or powder, commonly produces markedly cleaner, brighter metal surfaces near the injection point than other liquid additives and such surfaces generally do not build up undesired particles. Additionally, the use primarily of salts in the additive of the present invention, may inhibit corrosion of ductwork and electrostatic collection surfaces.

The additive can be mixed with a volatile carrier fluid, such as water, which vaporizes readily at the gas stream temperature (i.e., has a boiling point that is less than the gas stream temperature) to form particles (solid and/or liquid particles) of the additive(s). It is preferred that substantially all of the carrier fluid vaporize before the salt or derivative(s) thereof contacts the collection surface, which is commonly within no more than about 2 seconds after contact of the composition with the gas stream. The concentration in the carrier fluid of the additive(s) before injection into the gas stream, typically ranges from about 0.1 to about 5 wt. %.

While not wishing to be bound by any theory, dispersed particles of the additive are believed to be discrete from the undesired particles in the gas stream. Upon contact with the collection surface, the additive particles and the undesired particles form the agglomerate. After collection, the additive is believed to do most of the conditioning of the undesired particles. The preferred residence time of the droplets in the gas stream before contacting the collection surface preferably ranges from about 0.25 to about 2.00 seconds.

Preferably, to yield a substantially "dry system," the temperature of the collection surface in the collecting step is greater than both the condensation temperature of the water vapor in the gas stream and any vaporized carrier fluid. As used herein, a "dry system" refers to a system that employs a substantially dry collection surface (i.e., having substantially no liquid in contact therewith) for undesired particles. The dry system can include significant amounts of water vapor.

After a predetermined degree of build-up, the agglomerate of undesired particles and additive particles may be removed from the collection surface, collected in a hopper and removed from the unit. Removal maybe accomplished by vibration of the collection surface, removing the collection surface from the collection zone, or contacting the collection surface with a reverse gas stream having a direction of flow substantially opposite to the gas stream.

In a related embodiment of the invention, an apparatus for undesired particle removal is disclosed that includes (i) a housing; (ii) an inlet and outlet for the gas stream; (iii) an injection apparatus to inject an additive composition into the gas stream; and (iv) one or more collection surfaces supportably positioned within the housing to collect both the undesired particles to be removed and additive particles which, in turn, form an agglomerate on the collection surface. The apparatus may include a plurality of collection surfaces and one or more hoppers to collect the agglomerate that is removed from the collection surface.

The additive injection apparatus is preferably a plurality of dispersion devices (e.g., nozzles) positioned within and/or across the gas stream to uniformly disperse the additive composition into the gas stream. The additive injection apparatus may be advantageously located upstream of the collection surface at a distance sufficient for a substantial portion of any carrier fluid, preferably about 90% or more by weight, to separate by vaporization from the additive particles before the particles contact the collection surface.

In an electrostatic precipitator embodiment of the present invention, the apparatus may include a power supply; at least one electrode connected to the negative terminal of the power supply and positioned relative to the input gas stream to impart a charge to the undesired particles to be removed and the additive particles; and at least one collection surface connected to the positive terminal of the power supply and positioned parallel to the flow of the gas stream.

The additive of the present invention can have a number of advantages relative to existing additives, particularly under hot-side conditions. When the additive is added to the gas stream, the electrostatic precipitator, even under hot-side conditions, can remove sufficient undesired particles to form a gas stream that is in compliance with pertinent environmental regulations. The additive can be readily employed with existing electrostatic precipitators simply and inexpensively by retrofitting the precipitator with devices, such as nozzles or drip emitters, for injecting the additive into the gas stream. The injection of the additive into the gas stream upstream of the electrostatic precipitator rather than the addition of the additive to the coal feed can be done on an intermittent or as-needed basis, avoid or substantially inhibit boiler slagging and boiler and economizer fouling, increase the efficiency of the electrostatic precipitator, reduce undesired particle reentrainment during accumulation and/or removal of undesired particles from a collection surface, require only low consumption of the additive, overcome severe short-term resistivity changes associated with temperature swings during unit load changes, effectively condition particulate resistivity not only under hot-side but also cold-side conditions, provide a fast resistivity response when compared to bulk sodium addition and sodium precursors, have no detrimental effect on the performance of concrete made from conditioned undesired particles, and generally not increase the gas stream temperature downstream of the boiler, all preferably without significantly increasing capital and operating costs.

DETAILED DESCRIPTION

Figure 1:
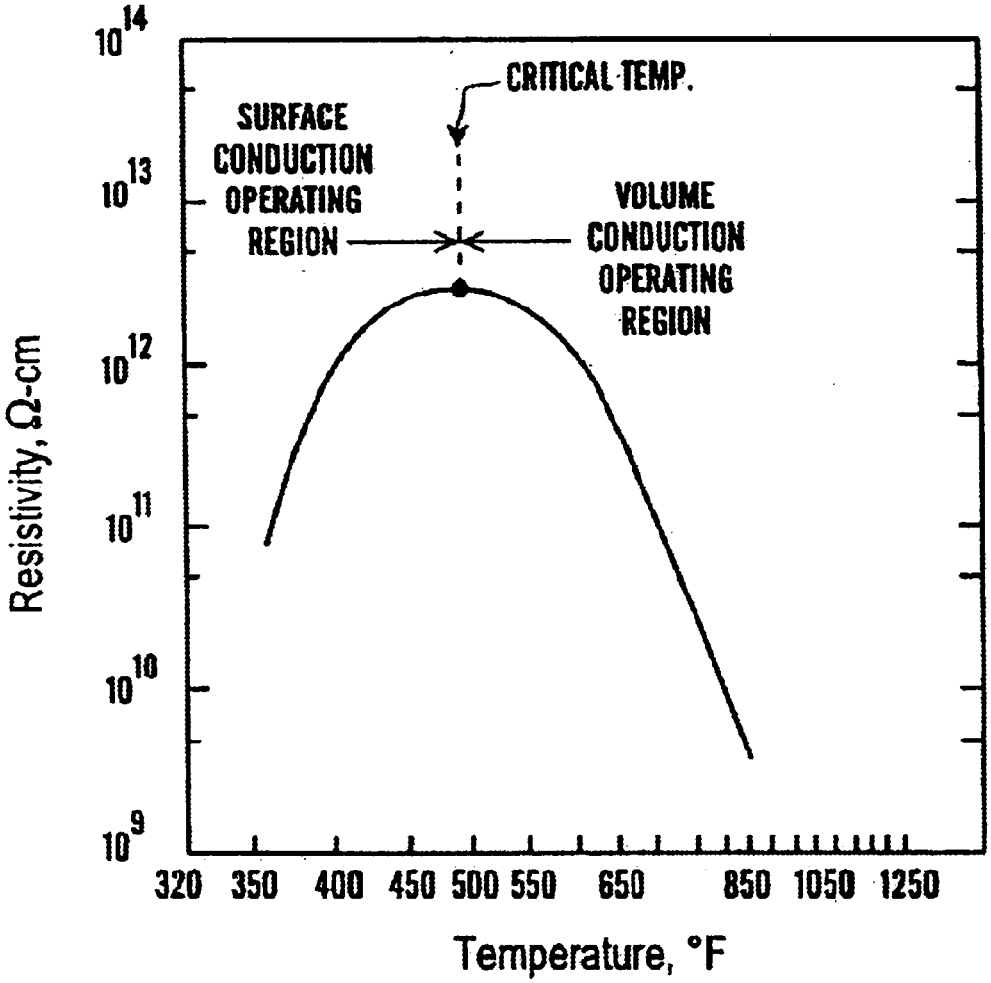
Fig. 1 PRIOR ART
FIG. 1 is a graph showing the relationship between particle temperature and particle resistivity for typical flyash particles.
Figure 2:
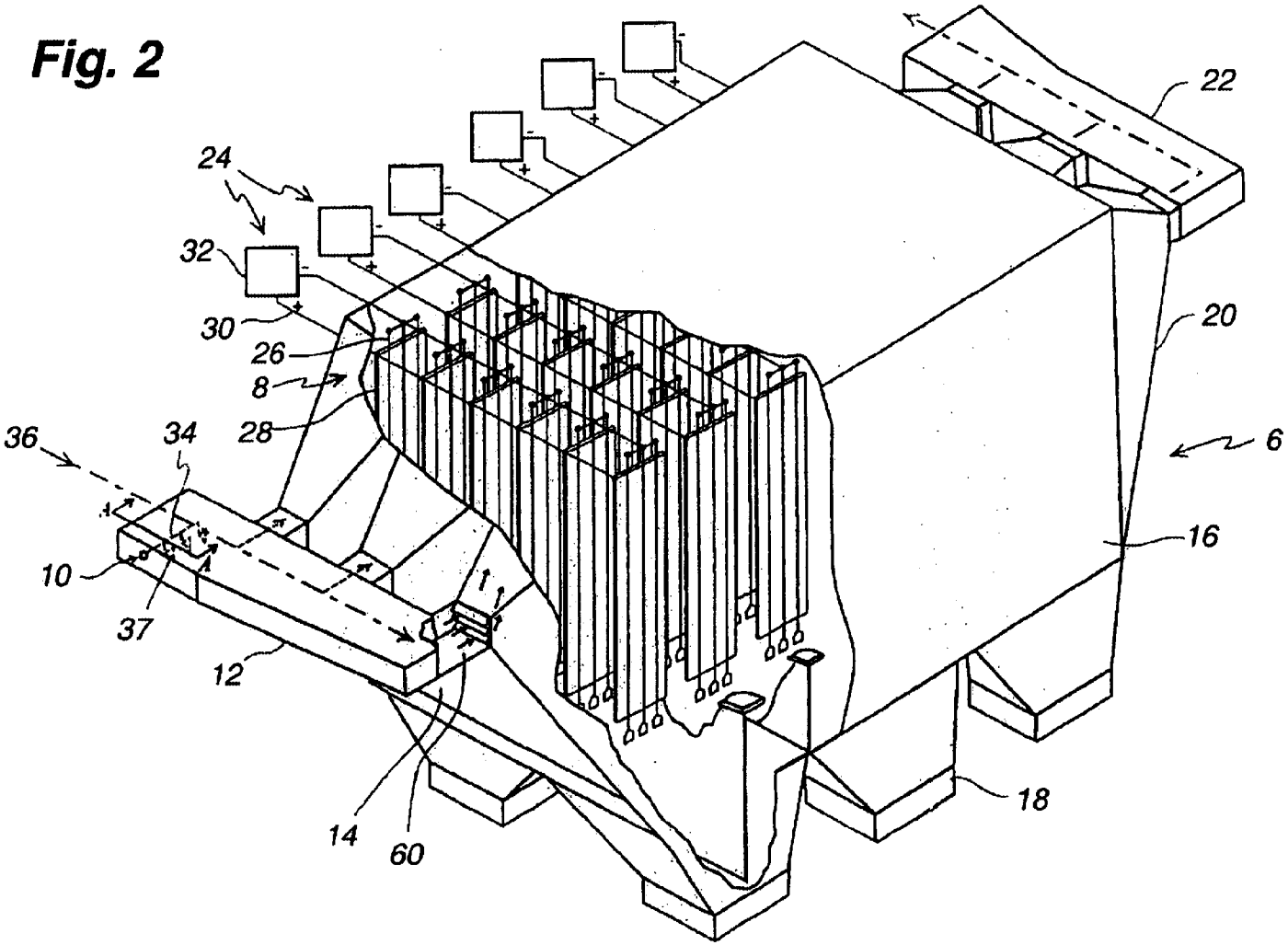
FIG. 2 is a perspective view of an embodiment of the present invention in an electrostatic precipitator.
Figure 3:
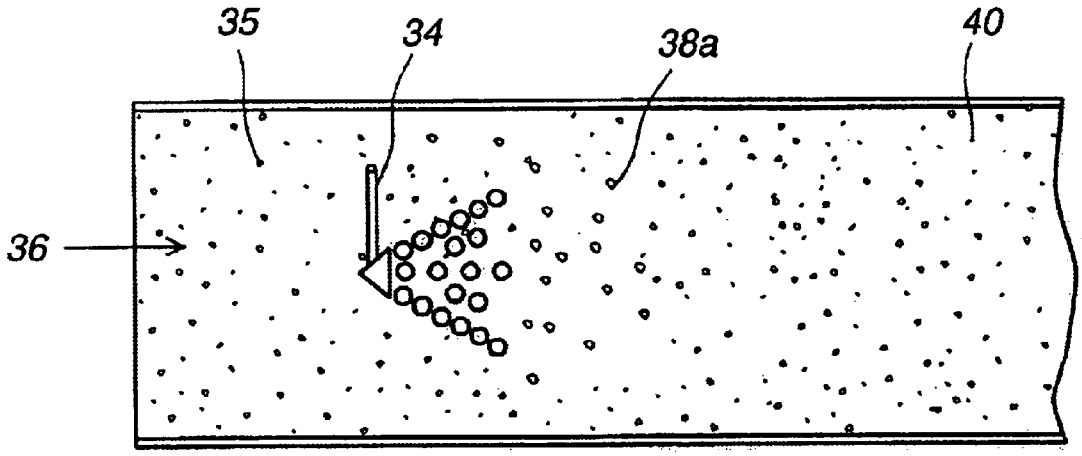
FIG. 3 is a cut away view along line A—A of FIG. 2 showing the additive injection device spraying droplets of the additive composition into the gas stream.

FIGS. 2 and 3 depict an embodiment of the present invention as implemented in an electrostatic precipitator for removal of undesired particles such as fly ash from a gas stream. The hot- or cold-side electrostatic precipitator includes housing assembly 6, precipitating assembly 8, and additive injection assembly 10. The housing assembly 6 includes an input duct 12, one or more input plenums 14, shell 16, one or more hoppers 18, one or more output plenums 20, and output duct 22.

The precipitating assembly 8 includes a plurality of sections 24. Each section 24 includes a plurality of alternately disposed discharge electrodes 26 and collection plates 28, a corresponding plurality of electrical conductors 90, and an interconnected power supply 32. The negative and positive terminals of the power supply 32 are connected to the discharge electrodes 26 and collection plates 28, respectively. The polarities of the electrodes and plates can be reversed, as desired.

The additive injection assembly 10 includes a reservoir (not shown) and an interconnected feed line 34 and plurality of nozzles 37. As will be appreciated, the gas stream may be contacted with the additive composition continuously or intermittently and by many different methods. Additive injection assembly 10 achieves contacting by atomizing the additive composition which includes a carrier fluid and the additive into the gas stream 36 in the form of droplets 38. Atomization may be realized by a number of different methodologies including spraying the composition through a nozzle. In a preferred configuration, the additive is injected as a fine spray or mist through an array of dual-fluid spray atomizers. To enhance additional charging of the droplets, particularly if an anionic or nonionic salt is employed, electrostatic injection nozzles (such as charged-fog nozzles or those employed in many paint sprayers) can be utilized. While preferred, a carrier fluid is not required to disperse additive particles in the gas stream 36. By way of example, additive particles 40 may be simply dripped into the gas stream 36 by a suitable device (e.g., a drip emitter).

As illustrated, additive injection assembly 10 should be located at a point in the duct that is downstream of the boiler economizer section and upstream of the precipitating assembly 8. The precise location of additive injection assembly 10 is typically selected such that the flue gas temperature at the location is less than the thermal decomposition temperature of the additive. For potassium nitrate (which has a thermal decomposition temperature of about 752° F.), the flue gas temperature at the point of injection should be no more than about 800° F. to avoid rapid thermal decomposition of the additive. Preferably, the additive injection assembly 10 is disposed so as to provide a sufficient distance between the additive injection assembly 10 and the nearest of the collection plates 28 such that, prior to contacting the nearest collection plate 28, a substantial portion of the carrier fluid, preferably at least about 90% and more preferably at least about 95% by weight, has separated from the additive and a substantially uniform dispersion of additive particles 40 across the gas stream 36 has been attained.

The initial spray droplet size is controlled to evolve a final droplet or solid additive particle that will remain entrained and co-precipitate with the undesired particles onto the ESP collection plates. Generally, spray droplet size is small enough to avoid deposition of liquid spray onto interior duct surfaces and supports. The additive injection assembly 10 is configured preferably to produce a spray droplet mass median diameter of from about 15 to about 25 microns diameter with about 90% of the droplet distribution being smaller than about 35 microns in diameter. The preferred Sauter Mean Diameters of the droplets 38 upon injection into the gas stream is from about 10 to about 100 micrometers and of the droplets (or particles) 38*a* after vaporization of the carrier fluid is from about 1 to about 20 micrometers and more preferably from about 2 to about 8 micrometers. Some of the droplets 38*a* will be smaller than these ranges due to the secondary breakup of the initial spray droplets. The liquid additive is preferably injected through dual-fluid atomizers at a pressure of from about 50 to about 120 pounds per square inch. High energy compressed air is generally contacted with the liquid in the atomizer to promote secondary breakup of the liquid droplets. The delivered pressure of the compressed air typically ranges from about 50 to about 120 psi. Air to liquid mass ratio (ALR) of the preferred dual-fluid atomizers is preferably maintained within a range of about 1 to about 5 and more preferably within a range of about 1.2 to about 2.6. To provide a substantially uniform droplet distribution across the cross-section of the duct, the additive injection assembly 10 is preferably located in input duct 12 with nozzles 37 evenly spaced across and within the gas stream 36 as illustrated.

The gas stream 36 can be deflected by a plurality of selectively adjustable baffles 60 (e.g., horizontally, vertically, and/or angularly) disposed across the gas stream before contacting collection plates 28 to achieve a more uniform incidence of undesired particles 35 and additive particles 40 on collection plates 28, thereby yielding an agglomerate of a more uniform thickness on collection plates 28.

The additive for reducing undesired particle resistivity preferably includes one or more oxidants, which is/are preferably a nitrite and/or nitrate with nitrate being even more preferred. Although the anion in the oxidant can be compounded with any cation, metal cations are preferred. Preferred additives include potassium nitrate, potassium nitrite, calcium nitrate, calcium nitrite, aluminum nitrate, sodium nitrate, and sodium nitrite, either alone or in combination. In a particularly preferred additive composition, potassium is the cation. In the preferred additive composition, the anion(s) can be compounded not only with potassium but also with one or more other metals, such as sodium, calcium, aluminum, and mixtures thereof.

The additive composition is surprisingly effective in reducing the resistivities of the collected undesired particles. Typically, under hot-side conditions the additives in the additive composition effect a resistivity reduction in at least most of the collected undesired particles of at least about 50% and more typically more than one order of magnitude or about 90%.

The additive can be introduced as a salt or a precursor thereof, such as a mineral acid (e.g., nitric or nitrous acid), and is preferably introduced in the form of a liquid. Because water is the most preferred carrier liquid, it is preferred that the oxidant be introduced in a water soluble form. It is possible, however, to use the ions in a vaporizable form.

In a preferred application, the additive is a concentrated solution to lower transportation costs and on-site storage requirements. The solubility of the preferred oxidant, namely potassium nitrate and/or nitrite, and the blended solution's freezing point determine the concentration and composition of the concentrated chemical additive. Because of the solubility limit of potassium nitrate and potassium nitrite in the solvent, nitrates and/or nitrates compounded with metals other than potassium, such as sodium, are utilized as supplementary additives to provide higher realizable nitrate and/or nitrite anion concentrations than would be realizable with potassium nitrate and/or nitrite alone. The various nitrates and/or nitrites are typically present in the liquid additive up to the extent of their respective solubility limits in the solvent. Typically, the total potassium nitrate and/or nitrite concentration(s) in the aqueous solution ranges from about 5 to about 30 wt. %, more typically from about 10 to about 25 wt. %, and even more typically from about 15 to about 20 wt. %. Commonly for metals other than potassium compounded with the nitrate and/or nitrite, the nitrate and/or nitrite concentration(s) associated with the metals ranges from about 5 to about 40 wt. %, more commonly from about 10 to about 30 wt. %, and even more commonly from about 20 to about 25 wt. %. The balance of the aqueous solution is preferably a vaporizable solvent such as water and/or an alcohol. The ratio of the number of moles of potassium nitrate and/or nitrite to the total number of moles of nitrates and nitrites compounded with metals other than potassium preferably ranges from about 0.1:1 to about 5:1, more preferably from about 0.2:1 to about 2:1, and even more preferably from about 0.5:1 to about 0.9:1. To provide optimum levels of solubility for the oxidants, the concentrated aqueous solution preferably has a pH ranging from about pH 6.5 to about pH 8.5.

To provide higher levels of solubility, the liquid additive can include a solubilizing agent. For potassium nitrate, a preferred solubilizing agent is a peroxygen compound such as a peroxide, with hydrogen peroxide being preferred. The solubilizing agent, when employed, typically is about 1 to about 3 wt. % of the liquid additive.

Prior to introduction into the flue gas stream, the concentrated aqueous additive is diluted with the vaporizable solvent (e.g., water) to form a (diluted) injection solution. Preferably, the solvent is added in a volumetric ratio of at least about 1 part solvent to one part of the concentrated aqueous additive, more preferably in a ratio of from about 2 to about 20 parts solvent to one part of the concentrated aqueous additive, and even more preferably in a ratio of from about 5 to about 10 parts solvent to one part of the concentrated aqueous additive. The injection solution preferably is at least about 75% solvent and more preferably ranges from about 90 to about 99% by weight solvent.

The concentrations of the oxidants in the (diluted) injection solution depend of course on the degree of dilution. Preferably, the total potassium nitrate and/or nitrite concentration in the injection solution ranges from about 0.5 to about 10 wt. %, more preferably from about 1 to about 6 wt. %, and even more preferably from about 2 to about 4 wt. %. Preferably for metals other than potassium compounded with the nitrate and/or nitrite, the metal nitrate and/or nitrite concentration in the injection solution ranges from about 0.5 to about 12 wt. %, more preferably from about 2 to about 8 wt. %, and even more preferably from about 2 to about 6 wt. %. The balance of the injection solution is preferably water.

In most applications, the total amount of the additive required to condition effectively the undesired particles is relatively low. Preferably, the additive-to-ash weight ratio (ATA) ranges from about 0.01 to about 5% by weight, more preferably from about 0.01% to about 2% by weight, and more preferably from about 0.05% to about 0.5% by weight.

The conditioning mechanism of the additive is not well understood. While not wishing to be bound by any theory, at least two theories, either individually or collectively, may explain the surprising effectiveness of the additives. Under one theory, the sodium, calcium, aluminum, potassium, nitrate, and/or nitrite ions are better charge carriers than the minerals normally present in the undesired particles. As a result, electrical charge can readily flow over the surface of the undesired particles under cold-side conditions (where the surface conduction mechanism is believed to predominate) or through the undesired particles under hot-side conditions (where the volume conduction mechanism is believed to predominate). The effect of this phenomenon is to lower the apparent resistivity of the undesired particles. Under another theory, the strongly oxidizing characteristics of the nitrate and nitrite anions are believed to be primarily responsible for the resistivity decrease. Nitrate and nitrite anions are chemically reactive with the collected undesired particles and with vapor phase species such as water vapor in the flue gas stream. An oxidation reaction on or in the undesired particle layer is believed to contribute to-the-enhanced electrical conductivity across the collected particle layer when a high voltage DC electrical field is applied. In an oxidation reaction, electrons are transferred, from the oxidant, or nitrate anion, there by facilitating the flow of electricity through the collected undesired particle layer. Under this theory, the more commonly known conditioning mechanism for high temperature ESPs of sodium or alkali metal ion charge carrier migration is believed to be, at most, a secondary effect with the alkali nitrate/nitrite salts.

While not wishing to be bound by any theory, the varying durations of the resistivity depression for the various additives are believed to be due to the varying degrees of stability of the additives in (or varying reaction rates with) the gaseous components of the flue gas stream and/or the collected undesired particle layer. The strongly oxidizing nitrate and nitrite chemicals are reactive not only with the undesired particle layer but also with vapor-phase species such as nitric oxide and sulfur dioxide. These and other competing vapor-phase reactions are believed to partially neutralize the additive chemical before precipitation onto (and reaction with) the fly ash layer. The rates of reaction of the oxidizers both with the vapor-phase species and with the collected particle layer are therefore important parameters in optimizing utilization of the additive. A slower reaction rate with vapor-phase species and/or with the undesired particles, such as is observed with potassium nitrate, is preferred for flue gas conditioning of ESPs. Slower reaction initially maximizes delivery of unreacted chemical onto the collected undesired particle layer. Then, the conditioning effect (induced current flow) through the collected undesired particle layer can be maintained for a period of hours to days afterwards. This-long additive life allows conditioned undesired particles to be removed, off the front-field plates and redispersed throughout the ESP.

The amount of the metal nitrates and nitrites required to condition the accumulated particle layer when blended is relatively small. Typically, the amount of the metal nitrates and nitrites that is used is no more than about 40 lb./ton of undesired particles and more typically ranges from about 1 to about 20 lb./ton of undesired particles.

The method of forming the additive will now be described. The additive is formed by adding the salt or precursor thereof in a suitable solvent, such as water. The mixture is stirred to facilitate dissolution of the salt or salt precursor and/or the salt precursor (e.g., mineral acid) reacted with suitable species (e.g., an oxygen-containing base) to form the salt. The pH of the mixture preferably ranges from about pH 6.5 to about pH 8.5 and the temperature from about 70 to about 120° F.

Figure 4:
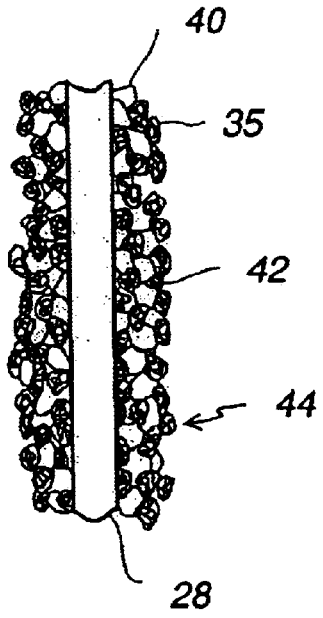
FIG. 4 is a side view of a collection plate showing an accumulation of additive particles and undesired particles on the collection plate.

With reference to FIGS. 2–4, the operation of the system will now be described.

Prior to injection, the additive is, as noted above, combined with a carrier fluid (e.g., water) (which is typically the same as the solvent) to form the additive composition. The water is typically combined with the additive in-line immediately before injection occurs.

The gas stream 36 containing the undesired particles 35 is passed through the input duct 10 and the input plenums 14 into the electrostatic precipitator shell 16. Before entering the electrostatic precipitator shell 16, the gas stream 36 passes the additive injection assembly 10. The additive injection assembly 10 disperses a plurality of droplets 38 of the additive composition into the gas stream 36 such that the droplets 38 are substantially uniformly dispersed across the cross-section of the duct.

After the droplets 38 are injected into the gas stream 36, the droplets 38 are carried downstream by the gas stream 36. As the droplets 38 are carried downstream, the droplets 38 decrease in size due to flashing of the carrier fluid to form smaller droplets 38*a* and even smaller particles 40. After equilibration with the flue gas temperature, the metal nitrates and nitrites form solid or semi-solid additive particles that are collected on the collection surface.

The vaporization time for the liquid carrier fluid in a droplet 38 depends primarily on the size of the droplet 38, the volatility of the liquid carrier fluid, and the temperature, pressure, and composition of the gas stream 36. Generally, the vaporization time for the liquid carrier fluid is less than about two seconds and more generally less than about one second.

After vaporization of the liquid carrier fluid, the additive particles 38*a* and/or 40 contact the collection plates 28. It is believed that most of the conditioning of undesired particles occurs after the undesired particles and additive particles are collected on the collection surface. The temperature of both the collection plate surface and the agglomerate of the undesired particles 35 and the additive particles 40 collected on the surface is preferably at least about 100° F. above the condensation temperature of water vapor in the gas stream 36. Further, the temperatures of both the collection plate surface and the agglomerate are preferably above the condensation temperature of the vaporized liquid carrier fluid.

The gas stream 36 containing the undesired particles 35 and the dispersed additive particles 40 enters the electrostatic precipitator shell 16. Discharge electrodes 26 impart a negative electrical charge to the undesired particles 35 and the additive particles 40. The negatively charged particles adhere to the positively charged collection plates 28. As the input gas stream moves away from the upstream section 24 to the downstream section 24, an increasing percentage of the undesired particles 35 and the additive particles 40 accumulate on the collection plates 28.

FIG. 4 is a side view of a portion of a collection plate that contains an agglomerate of the undesired particles 35 and the additive particles 40. For illustration purposes only, the size and number of the particles 40 are exaggerated relative to the size and number of the undesired particles 35. As will be appreciated, the particles 40 are commonly much smaller and significantly less numerous than the particles 35. As depicted, after contacting collection plate 28 the additive particles 40 are trapped in the interparticle gaps between the undesired particles 35, thereby yielding the desired agglomerate. The particles 40 can oxidize the undesired particles and/or provide charge carriers that can migrate through the agglomerate in response to the voltage drop across the agglomerate. In this manner, the additive particles can reduce undesired particle resistivity by as much as three orders of magnitude for temperatures above about 260° C. (500° F.). The lower resistivity commonly results in improved precipitator performance, improved particulate collection, reduced sparking in the agglomerate, and lower stack opacity.

Referring to FIGS. 2–4, the agglomerate can be removed from the collection plate 28 by many techniques, including rapping of the collection plate 28 and sonic horns. The preferred methodology for agglomerate removal involves mechanical impact of the collection plate 28. When the collection plate 28 is impacted, the agglomerate separates from the collection plate 28 in large sheets and falls into the hoppers 18 for disposal.

EXAMPLE 1

A series of tests were conducted in the laboratory to evaluate various conditioning agents. A further test was conducted with a modified (solid) injection method. The protocol for all of the tests set forth below had two stages. In the first stage, fly ash was conditioned dynamically in a heated spray chamber, simulating actual full-scale injection conditions in a coal combustion flue duct or industrial off-gas stream. In the second stage, the resistivity of the conditioned fly ash was measured at selected temperature intervals in a high voltage test fixture housed inside a laboratory furnace.

In the first stage, fly ash conditioning was performed under carefully controlled conditions. A constant flow of hot carrier gas (air with 10% moisture by volume) was maintained through the spray chamber and a downstream filter chamber. Fly ash was metered into the spray chamber from the top at a rate of approximately 8 gm/minute using a vibratory tray dust injector. The moist carrier as atmosphere inside the chamber was isolated from the dust feeder by a dual-action pneumatic isolation valve. The injected fly ash was entrained into the carrier gas flow and dispersed throughout the spray chamber. In Tests 1 through 3, a dilute liquid additive was sprayed into the spray chamber in a co-current direction with entrained fly ash and carrier gas. The injected chemical was finely atomized with a dual-fluid atomizing spray nozzle with compressed air as the motive fluid. For all additives, the injection rate was set between 2–3 ml of an approximately 0.6 gm/ml solution of chemical in distilled water. The liquid flow rate and the entrained fly ash concentration realistically simulated additive injection at actual full-scale conditions. The heated fly ash and the additive spray were mixed with this, hot, moist carrier gas in the spray chamber and then were collected onto a high efficiency fabric filter located immediately downstream. Surface heaters around the spray chamber produce a stable gas and interior chamber surface temperature to as high as 450° C. (850° F.). The heaters were controlled through two zones of automatic temperature control. Further temperature control was provided by an inlet humidification chamber and surface heaters on the inlet air line. The conditioning phase of each test was run for 30 to 45 minutes. Then the spray and ash feed was stopped, heating was discontinued, and the bag filter with collected fly ash was removed. The total liquid additive injected and the total fly ash collected on the bag filter were measured gravimetrically. From these two measurements, a precise calculation of additive-to-ash weight ratio (ATA) was made. Due to unavoidable variation in ash feed rate, the actual additive-to-ash weight ratio for each test varied slightly. Table 1 summarizes the additives tested, and for each additive tested provides the conditioning rate expressed as a weight percentage of the ash and the temperature during sample conditioning.

TABLE 1

Sample Conditioning Summary

| Additive Name | Conditioning Rate, Additive-to-Ash (Wt. %) | Anion Dosing (Nitrate Wt. %) | Spray Chamber Temperature during injection (C.°/° F.) |
|---|---|---|---|
| Baseline, no conditioning | 0.0 | 0.0 | |
| Blend of sodium formate/sodium hydroxide | 0.53 | 0.0 | 407/765 |
| Sodium Nitrate | 0.48 | 0.35 | 391/736 |
| Calcium Nitrate | 0.47 | 0.36 | 389/732 |
| Nitric Acid | 0.49 | 0.48 | 376/708 |
| Potassium nitrate | 0.62 | 0.38 | 394/742 |

The fly ash was from the Powder Basin.

In the second stage of all tests, the resistivity of the conditioned fly ash was measured using standard techniques as set forth in IEEE Standard 548, from IEEE Standard Criteria and Guidelines for the Laboratory Measurement and Reporting of Fly Ash Resistivity. The conditioned fly ash was mixed mechanically in the bag and then placed onto a standard IEEE resistivity test cell with a layer thickness of 0.5 cm. The resistivity cell with ash was placed into a laboratory furnace with high voltage connections to multiple resistivity cells and with inlet and outlet gas connections to a humidification generator. Electrical connections to the high voltage power supply were fixed, the resistivity furnace was sealed and a flow of moist, hot carrier gas was introduced. The fly ash layer on the resistivity cells was allowed to equilibrate to temperature and moisture at the lowest measurement point, typically 250° F. (121° C.). Electrical resistivity was then determined by measurement of electrical current flow across the ash layer at a fixed DC voltage and electric field strength (nominally 4 kv/cm). Temperature was then raised and stabilized at the next measurement point and the resistivity measurement was repeated. Data was taken at multiple points about 80° F. (27° C.) apart on an ascending curve typically from 250° F. to as much as 880° F. (121 to 470° C.). There was typically a 30-minute wait between data points to equilibrate ash layer temperature.

In interpreting the test results, there are certain inherent limitations and other factors that should be considered. First, the residence time in the hot zone of the spray chamber was typically about 5 to 8 seconds, which is similar to or longer than an actual injection performed upstream of an electrostatic precipitator. Second, after exiting the hot zone of the spray chamber, the fly ash is contacted with the additive on a filter bag downstream at a temperature of no more than 420° F. (216° C.). Third, the collected fly ash is cooled, allowing a temperature excursion through the moisture dewpoint. Fourth, fly ash is sealed in a 5 gallon bucket before use, but no attempt is made to maintain exact moisture content in the stored ash. Typically, the surrounding air is very dry and the ash reaches a near-constant desiccated condition. Moisture content of the fly ash is not considered significant for hot-side comparative tests but can be important when measuring resistivity at cold side temperatures, typically less than about 400° F. (204° C.). Fifth, the effect of reactive minor constituents of the flue gas (under actual conditions), such as SOx and NOx, is not adequately simulated in the resistivity tests. Finally, when measuring very low resistivity with the resistivity test fixture, the maximum current measurement was 1.9 mA and the typical minimum resistivity at could be measured was $3\times10^{6}$ ohm-cm. This condition appears as an apparent lower limit on all resistivity curves. The actual resistivity at the highest temperatures with the more effective additives could be significantly lower than reported.

EXPERIMENT 1

Figure 5:
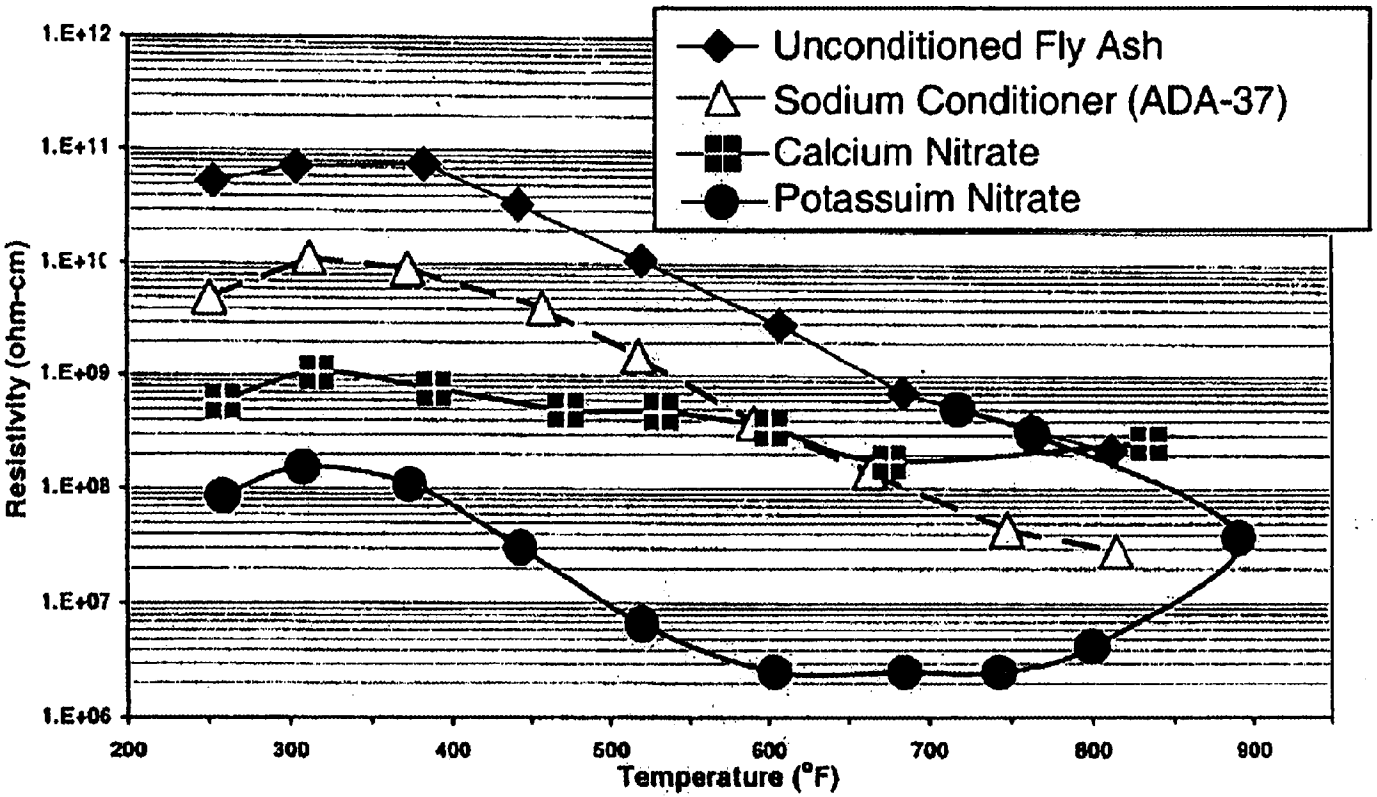
FIG. 5 is a plot of undesired particle resistivity versus temperature for various additives.

In experiment number 1, fly ash resistivity of a common Powder River Basin (PRB) fly ash was measured with and without flue gas conditioning. The resistivity response of the various additives were evaluated over a temperature range from 250–900° F. with carrier gas moisture at 10% by volume. These were compared against a sodium-precursor additive (blend of sodium formate/sodium hydroxide shown as ADA 37), with an equivalent concentration of nitric acid, and against the unconditioned PRB fly ash. The conditioning and sample preparation procedures are as described above. The conditioning rate was controlled to achieve comparable $NO_3$ anion concentration in the fly ash (Table 1). Results from Experiment 1 are shown in FIG. 5. Major conclusion are as follows:

- Potassium nitrate was surprisingly effective as a resistivity conditioner through most of the temperature range.
- After prolonged exposure at high temperature (>750° F.) the ash layer conditioned with potassium nitrate reverted to the unconditioned (baseline) curve. This indicates that conditioning effect is not reversible at higher temperatures.
- Calcium nitrate was effective in the middle temperature range but showed poor response above 600° F.
- The sodium conditioner ADA-37 exhibited a roughly constant relative resistivity response throughout the range tested. This is consistent with expected enrichment of sodium ion charge carriers in the fly ash that should not be affected by process temperature changes.

EXPERIMENT 2

Figure 6:
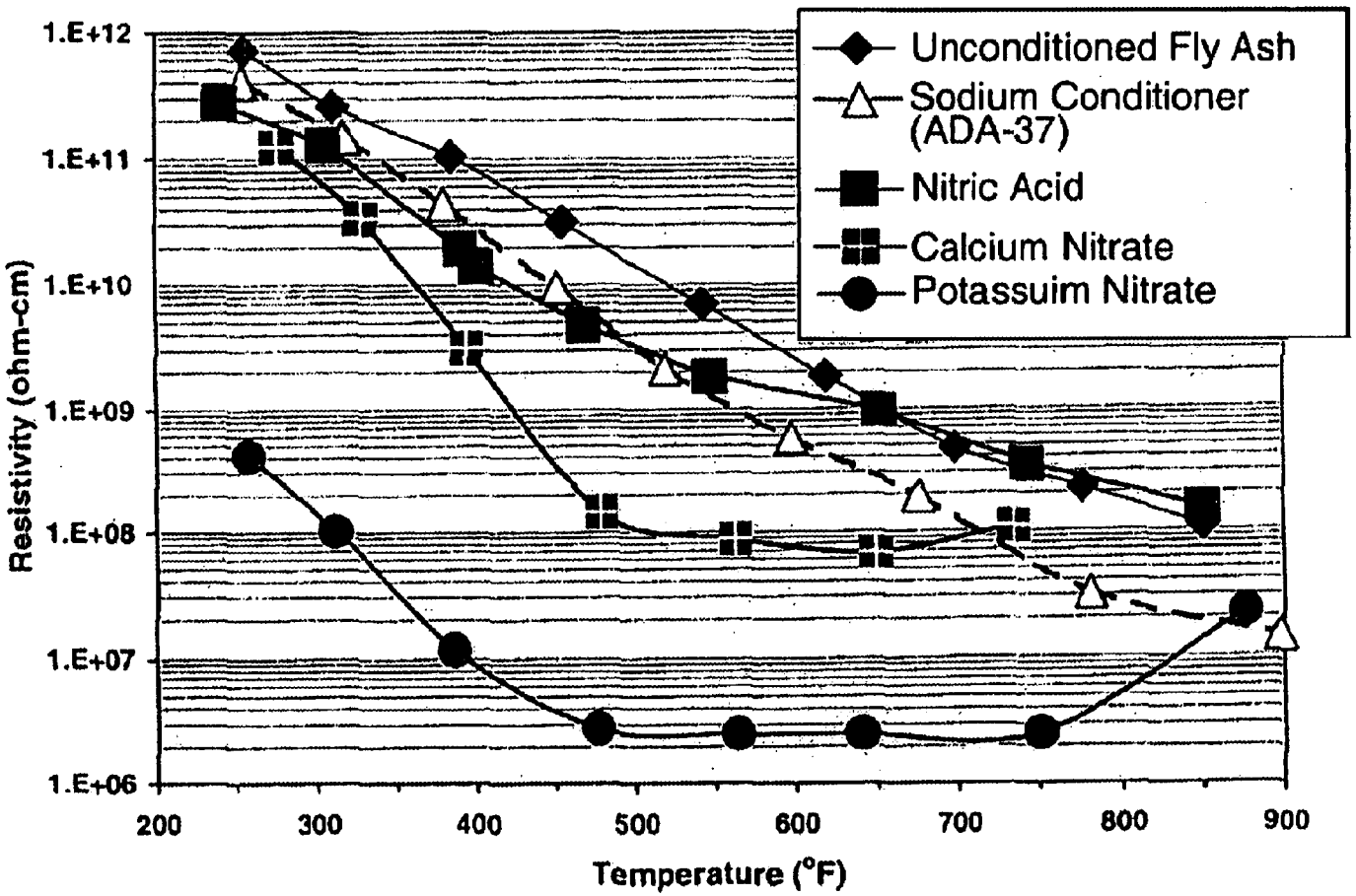
FIG. 6 is a plot of undesired particle resistivity versus temperature for various additives.

In Experiment number 2, the resistivity of additional samples of the fly ash that had been conditioned in Experiment 1 were evaluated in a dry air environment to assess the effect of flue gas moisture on the results. Dilute nitric acid was also tested as a conditioner even though it is likely too corrosive to be used in a commercial additive. Experiment 2 results are shown in FIG. 6. Both calcium and potassium nitrate were seen to be effective even without moisture in the carrier gas. Potassium nitrate was again the best-performing additive but calcium nitrate was also effective over a narrower temperature range. This was surprising because other calcium salts such as calcium phosphates or sulfates bad been previously tested and been found to either have no effect on ash resistivity or to detrimentally increase resistivity. This finding reinforces the conclusion that an oxidation reaction with the ash or with vapor species in contact with the ash may be responsible for the resistivity modification rather than any effect of the calcium or potassium cations as charge carriers.

The results with nitric acid suggest that the reaction rate of the acid with fly ash is extremely rapid compared to the alkali nitrate conditioners such as potassium nitrate. The negligible resistivity modification with nitric acid compared to the other nitrate salts may be due to immediate reaction and neutralization of the acid on the ash prior to the measurement portion of the test.

EXPERIMENT 3

This experiment was conducted to measure the variation in ash resistivity of a conditioned ash layer over a period of up to 48 hours. Additional samples of the potassium nitrate—and ADA-37—conditioned ashes were tested. For comparison, a sodium nitrate-conditioned ash sample was also tested. The ash samples were contacted with equi-molar amounts of potassium nitrate on the one hand and sodium nitrate on the other. The ash samples were first equilibrated to a constant temperature in the resistivity furnace. Then the ash layer resistivity was measured periodically by applying a DC voltage. The DC electrical field was turned off between measurements. Carrier gas was not humidified for this test.

Figure 7:
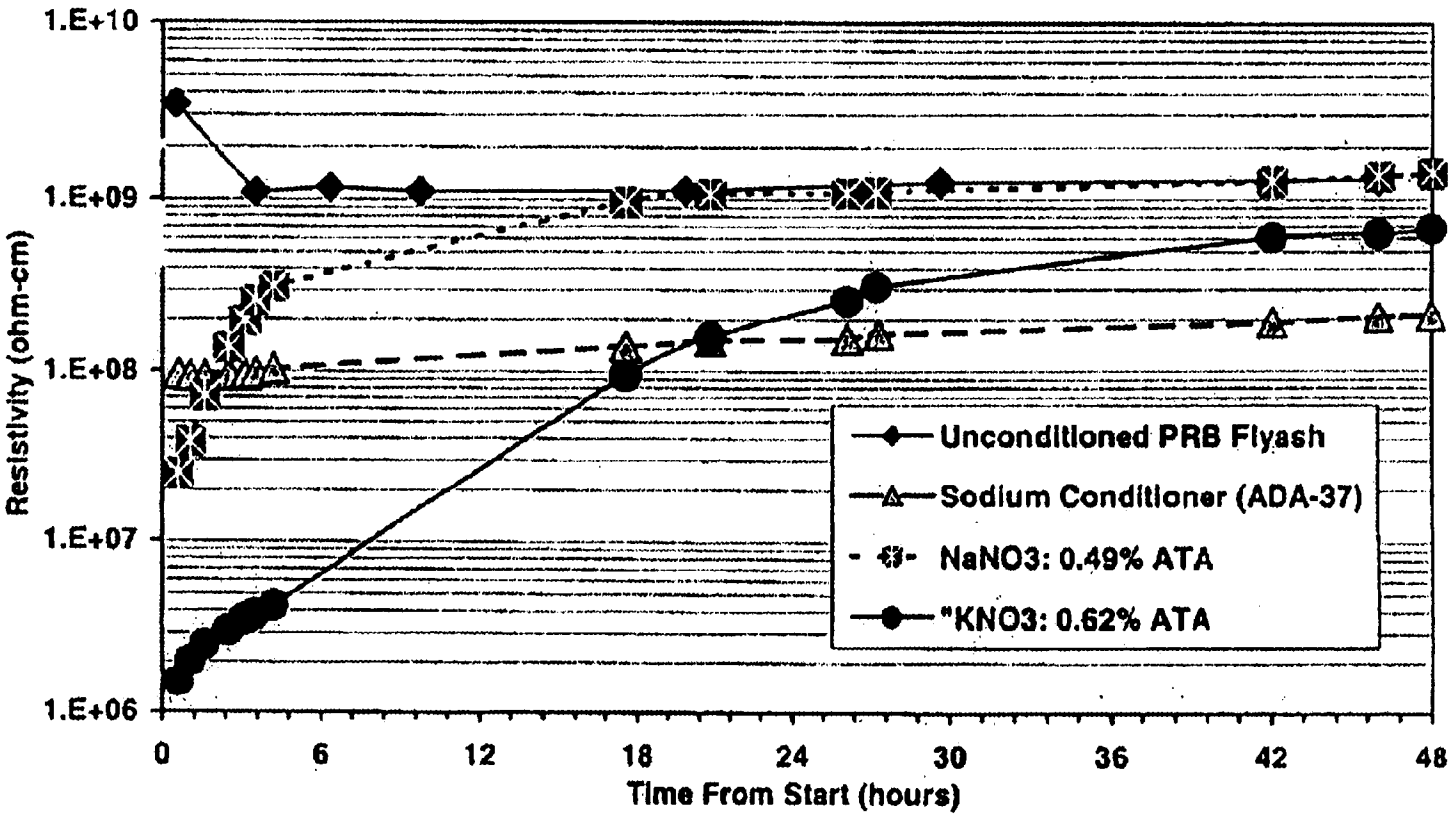
FIG. 7 is a plot of undesired particle resistivity versus time from injection for various additives.

Results are plotted in FIG. 7. The potassium nitrate sample layer again shows maximum resistivity reduction. However, the resistivity does increase over time to an endpoint comparable to the baseline ash. The ADA-37-conditioned ash has much less initial response but resistivity remains nearly constant over time. The sodium nitrate-conditioned ash shows both less initial resistivity effect and a faster degradation compared to potassium nitrate-conditioned ash. This experiment illustrates the distinct differences between the nitrate chemicals and ADA-37.

EXPERIMENT 4

Experiment number 4 was conducted to evaluate the feasibility of the addition of nitrate flue gas conditioners as solid materials.

In Experiment 4, finely divided powder $KNO_3$ was co-injected with the fly ash through the vibratory tray feeder and the double pneumatic isolation valve of the laboratory test fixture. The solid additive was then co-filtered onto the final bag filter with the ash. All other test parameters, including temperature, moisture and collection, were identical to the previous tests.

Figure 8:
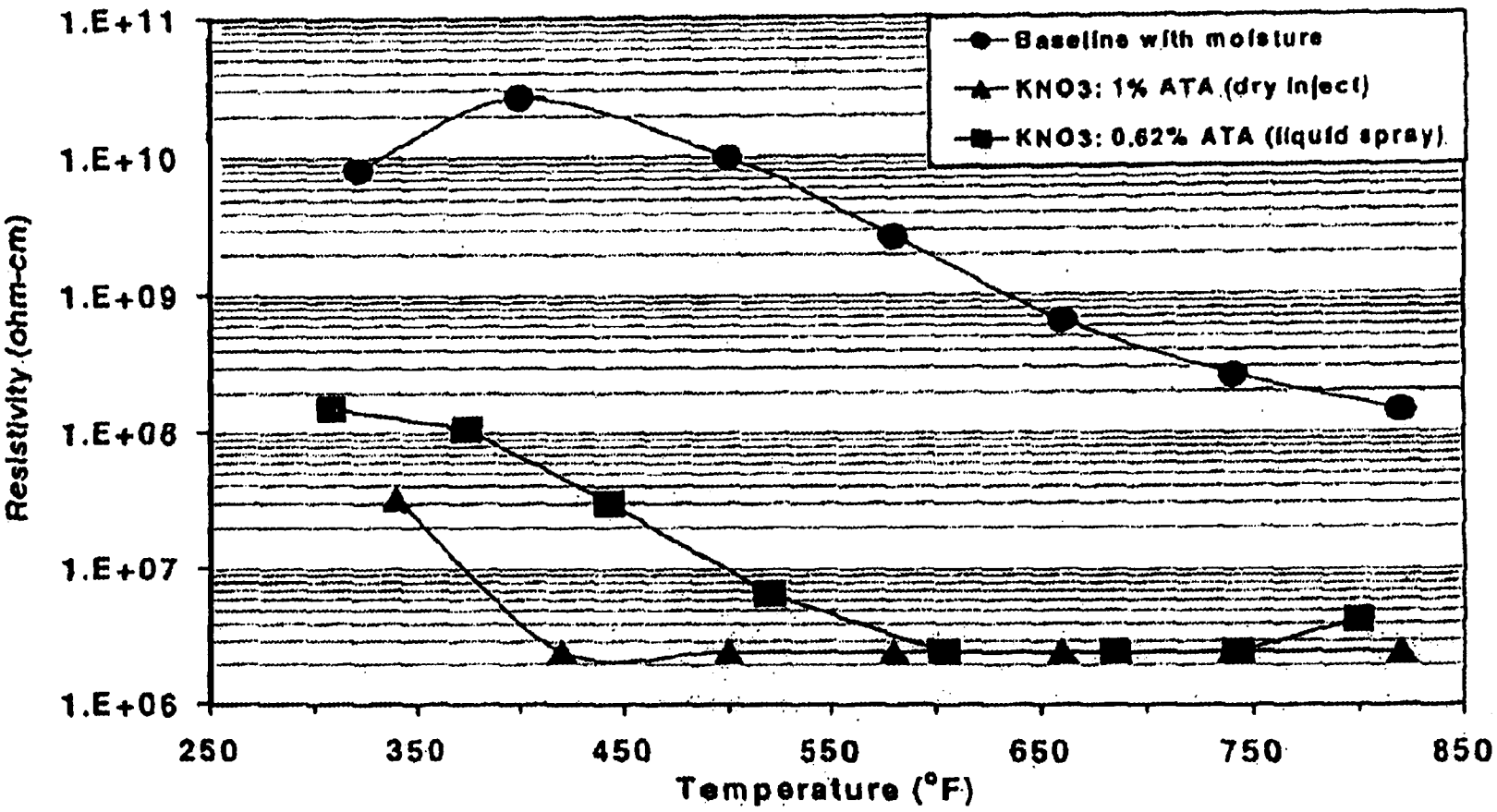
FIG. 8 is a plot of undesired particle resistivity versus temperature for various additives.

As seen in FIG. 8 at an additive-to-ash wt. ratio of 1% the resistivity of the PRB fly ash is reduced by more than 3 orders of magnitude. By comparison, the same ash conditioned with a dilute liquid spray of $KNO_3$ at a rate of 0.6% additive-to-ash gave similar results. At this time further tests need to be run full-scale to quantify utilization with dry injection. However, given the substantial advantages of not relying upon spray atomization into the flue duct and the inherent difficulties associated with it, such as in-duct deposition, this concept appears attractive for the new additive chemicals.

A number of variations and modifications of the invention can be used. It would be possible to provide for some features of the invention without providing others.

For example in one alternative embodiment though the invention has been described above with reference to the conditioning of flue gas to provide improved ESP performance at electric utility coal-fired power plants, it is to be understood that the additive(s) can be utilized for conditioning of any other high resistivity industrial dusts or process materials where electrostatic precipitation is used as the particulate control device.

In another alternative embodiment, the additives noted above are injected into the duct as a finely divided powder. One drawback to the strongly oxidizing nitrate salts for resistivity conditioning is their reactivity to other vapor-phase flue gas species such as sulfur oxides ($SO_x$) and nitrogen oxides ($NO_x$). Reaction with gas-phase species such as $SO_x$ prior to co-precipitation on the flyash results in less reactive chemical reaching the collection plates of the ESP. Therefore, it is desirable to minimize substantially or inhibit any flue gas reaction with the additive chemicals. This is particularly important for coal-fired plants burning medium sulfur fuels where a higher concentration of sulfur dioxide and sulfur trioxide is present in the flue gas. In this situation, one method to inhibit the reaction with vapor flue gas species is to inject the additive chemicals as a finely divided solid powder. The solid material will have less exposed reactive surface area compared to spray liquid droplets and, therefore, should have a slower rate of reaction with vapor-phase components (e.g., nitrous oxides and sulfur oxides) and longer term conditioning effect on the collected undesired particles).

For solid injection, particle size is an important parameter that is controlled to optimize distribution and prevent fallout of chemical in the duct work. Particle size for solid injection is preferably no more than about 15 microns aerodynamic diameter and preferably in the range of from about 5 to about 12 microns aerodynamic diameter. At least about 80% of the particles preferably fall within these particle size ranges. The material is blown in through an array of injection lances using dry air or other dry gas such as nitrogen as a carrier gas. With solid injection, a single-component material is preferred because there are no solubility limitations on additive formulation. For potassium nitrate or nitrite, for example, the additive is preferably at least about 25% by weight, more preferably at least about 50% by weight, and even more preferably at least about 75% by weight potassium nitrate, potassium nitrite or a mixture thereof.

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g., for improving performance, achieving ease and\or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streaming the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover though the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A process for removing undesired particles from a gas stream, comprising:

contacting said gas stream with an additive composition comprising at least one of potassium nitrate and potassium nitrite and collecting at least a portion of the undesired particles and at least a portion of the additive composition or a derivative thereof on a collection surface to form on said collection surface an agglomerate comprising the at least a portion of the additive composition and the at least a portion of the undesired particles.

2. The process, as claimed in claim 1, further comprising: removing said agglomerate from said collection surface.

3. The process, as claimed in claim 1, wherein the collection surface has a temperature of at least about 250° C.

4. The process, as claimed in claim 3, wherein the at least a portion of the additive composition comprises a plurality of additive particles and collecting step further comprises:

imparting an electrical charge to the undesired particles and additive particles and electrically attracting said electrically charged undesired particles and additive particles to the collection surface.

5. The process, as claimed in claim 1, wherein the at least a portion of the additive composition comprises a plurality of additive particles and said collecting step comprises filtering said undesired particles and additive particles containing said additive composition from said gas stream.

6. The process, as claimed in claim 1, wherein the additive composition comprises potassium nitrate.

7. The process, as claimed in claim 6, wherein said additive composition further comprises a nitrate and/or nitrite compounded with at least one metal other than potassium.

8. The process, as claimed in claim 7, wherein the additive composition, upon contact with the gas stream, comprises at least about 0.5 wt % of potassium nitrate and at least about 0.5 wt % of the nitrate and/or nitrite compounded with at least one metal other than potassium.

9. The process, as claimed in claim 7, wherein the at least one metal other than potassium is at least one of sodium, calcium, and aluminum.

10. The process, as claimed in claim 3, wherein the temperature of said collection surface is greater than the condensation temperature of water and the carrier fluid.

11. The process, as claimed in claim 1, wherein said additive composition comprises potassium nitrite.

12. The process, as claimed in claim 1, wherein the additive composition is in the form of a solid, when contacted with the gas stream.

13. The process, as claimed in claim 1, wherein the additive composition further comprises a solubilizing agent.

14. The process, as claimed in claim 13, wherein the solubilizing agent is a peroxygen compound.

15. The process, as claimed in claim 7, wherein a molar ratio between the at least one of potassium nitrate and potassium nitrite on the one hand and the nitrate and/or nitrite compounded with at least one metal other than potassium on the other ranges from about 0.2:1 to about 2:1.

16. A process, as claimed in claim 12, wherein the solid additive composition comprises at least about 25 wt % of the at least one of potassium nitrate and potassium nitrite.

17. A process, as claimed in claim 1, wherein the additive composition comprises at least about 75 wt. % solvent.

18. A process for removing undesired particles from a gas stream, comprising:

contacting said gas stream with a plurality of particles comprising a liquid additive composition including an oxidant and a solubilizing agent; and collecting at least most of said undesired particles and liquid additive particles on a collection surface to form an agglomerate, wherein the oxidant comprises at least one of a nitrate and nitrite and the at least one of nitrate and nitrite is compounded with potassium.

19. The process, as claimed in claim 18, wherein the liquid additive composition comprises a carrier fluid and wherein the temperature of said collection surface is greater than the condensation temperature of water and the carrier fluid.

20. The process, as claimed in claim 19, wherein said liquid additive particles are in the form of droplets and the droplets have a first Sauter Mean Diameter upon contacting with the gas stream ranging from about 20 to about 150 microns and, after vaporization of the carrier fluid, a second Sauter Mean Diameter ranging from about 1 to about 10 microns and further comprising at least one of the following steps:

imparting an electrical charge to the undesired particles and additive particles and electrically attracting said electrically charged undesired particles and additive particles to the collection surface; and filtering said undesired particles and additive particles containing said additive composition from said gas stream.

21. The process, as claimed in claim 18, wherein the liquid additive composition comprises at least about 10 wt. % of the at least one of a potassium nitrate and potassium nitrite.

22. The process, as claimed in claim 18, wherein the liquid additive composition further comprises a mineral acid.

23. The process, as claimed in claim 18, wherein at least some of the oxidant is compounded with a metal and the metal is at least one of sodium, calcium, and aluminum.

24. The process, as claimed in claim 18, wherein the collection surface has a temperature of at least about 250° C.

25. The process, as claimed in claim 18, wherein the additive composition comprises potassium nitrate.

26. The process, as claimed in claim 18, wherein the additive composition further comprises a solubilizing agent.

27. The process, as claimed in claim 26, wherein the solubilizing agent is a peroxygen compound.

28. A process for conditioning undesired particles in a gas stream, comprising:

contacting, with a gas stream comprising undesired particles, an additive composition comprising an oxidant, at least some of the oxidant being compounded with potassium; and imparting an electric charge to the undesired particles and particles of the additive composition; and collecting the charged undesired particles and additive composition particles on one or more electrically charged surfaces, wherein the oxidant comprises a nitrogen-containing anion selected from the group consisting essentially of a nitrate, a nitrite, and mixtures thereof.

29. The process, as claimed in claim 28, wherein at least some of the nitrogen-containing anion is compounded with a metal selected from the group consisting essentially of sodium, calcium, and aluminum.

30. The process, as claimed in claim 28, wherein at least about 25 mole % of the oxidant is compounded with potassium and the additive composition comprises at least about 10 wt. % of the oxidant.

31. The process, as claimed in claim 28, wherein the oxidant and potassium effect a resistivity reduction in at least some of the collected undesired particles of at least about 50%.

32. The process, as claimed in claim 28, wherein the additive composition is in the form of a liquid and comprises a solubilizing agent.

33. The process, as claimed in claim 32, wherein the solubilizing agent is a peroxygen compound.

34. The process, as claimed in claim 33, wherein the peroxygen compound is a peroxide.

35. The process, as claimed in claim 28, wherein the additive composition, upon contact with the gas stream, comprises at least about 0.5 wt % of potassium nitrate and at least about 0.5 wt % of the nitrate and/or nitrite compounded with at least one metal other than potassium.

36. The process, as claimed in claim 29, wherein the additive composition comprises potassium nitrate.

37. The process, as claimed in claim 29, wherein the additive composition comprises potassium nitrite.

38. A process for removing undesired particles from a gas stream, comprising:

contacting said gas stream with a plurality of solid additive particles comprising an oxidant selected from the group consisting essentially of nitrates, nitrites, and mixtures thereof; wherein the plurality of particles are in the form of a free-flowing solid powder when contacted with the gas stream and wherein at least some of the oxidant is compounded with potassium; and electrically collecting at least most of the undesired particles and additive particles on a collection surface to form an agglomerate.

39. The process as claimed in claim 38, wherein at least some of the oxidant is compounded with a metal selected from the group consisting essentially of an element in Groups 1, 2, 6, 7, 8, 9, 10, 11, 12 and 13 of the Periodic Table and mixtures thereof and wherein the particles comprise at least about 25 wt. % of the oxidant.

40. The process, as claimed in claim 38, wherein at least about 80% of the additive particles have a particle size of no more than about 15 microns.

41. The process, as claimed in claim 38, wherein the collection surface has a temperature of at least about 250° C.

42. The process, as claimed in claim 38, wherein the additive particles comprise potassium nitrate.

43. The process, as claimed in claim 38, wherein the additive particles comprise potassium nitrite.

44. The process, as claimed in claim 38, wherein the additive particles further comprise a solubilizing agent.

45. The process, as claimed in claim 44, wherein the solubilizing agent is a peroxygen compound.

* * * * *